US005518876A

United States Patent [19]

Parton et al.

[11] Patent Number: 5,518,876

[45] Date of Patent: May 21, 1996

[54] RED SENSITIZERS FOR HIGH SILVER CHLORIDE EMULSIONS

[75] Inventors: Richard L. Parton, Webster; David A. Stegman, Churchville; Pamela M. Ferguson, Farmington, all of N.Y.

[73] Assignee: Eastman Kodak Company, Rochester, N.Y.

[21] Appl. No.: 413,972

[22] Filed: Mar. 29, 1995

Related U.S. Application Data

[63] Continuation of Ser. No. 991,695, Dec. 16, 1992, abandoned.

[51] Int. Cl.[6] ..... G03C 1/20; G03C 1/28

[52] U.S. Cl. ..... 430/573; 430/576; 430/584; 430/963

[58] Field of Search ..... 430/573, 576, 430/584, 963

[56] References Cited

U.S. PATENT DOCUMENTS

| | | | |
|---|---|---|---|
| 2,481,022 | 9/1949 | Kendall et al. | 430/594 |
| 2,875,058 | 2/1959 | Carroll et al. | 96/104 |
| 4,618,570 | 10/1986 | Kadowaki et al. | 430/505 |
| 4,939,080 | 7/1990 | Hioki et al. | 430/576 |
| 5,061,618 | 10/1991 | Parton et al. | 430/584 |
| 5,093,226 | 3/1992 | Ohshima | 430/584 |
| 5,108,882 | 4/1992 | Parton et al. | 430/502 |
| 5,126,235 | 6/1992 | Hioki | 430/505 |
| 5,166,047 | 11/1992 | Hioki et al. | 430/573 |
| 5,175,080 | 12/1992 | Hioki et al. | 430/584 |
| 5,290,675 | 3/1994 | Hioki et al. | 430/576 |

FOREIGN PATENT DOCUMENTS

| | | | |
|---|---|---|---|
| 0244184 | 11/1987 | European Pat. Off. . | |
| 297804 | 1/1989 | European Pat. Off. | 430/576 |
| 0317825 | 5/1989 | European Pat. Off. . | |
| 0367227 | 10/1989 | European Pat. Off. . | |
| 0364990 | 10/1989 | European Pat. Off. . | |
| 0368356 | 5/1990 | European Pat. Off. . | |
| 0313021 | 4/1991 | European Pat. Off. . | |
| 0532042A1 | 3/1993 | European Pat. Off. . | |
| 0313022 | 3/1993 | European Pat. Off. . | |
| 563860 | 10/1993 | European Pat. Off. . | |
| 60-220339 | 11/1985 | Japan . | |
| 04146431 | 9/1988 | Japan . | |
| 4-146428 | 5/1992 | Japan . | |
| 04358141 | 12/1992 | Japan . | |
| 604217 | 6/1948 | United Kingdom . | |

OTHER PUBLICATIONS

Luo et al., "Studies of Supersensitization of Some Bridged Dicarbocyanines by Triazino Stilbenedisulfonic Acids", Journal of Imaging Science, 32(2), 1988, pp. 81–84.

*Primary Examiner*—Janet C. Baxter
*Attorney, Agent, or Firm*—Gordon M. Stewart; Edith A. Rice

[57] ABSTRACT

A photographic materials with a high silver chloride red sensitive layer which has a high sensitivity and exhibits reduced thermal sensitivity. In particular the material has a silver halide emulsion of at least 90% silver chloride and compounds of formula I and II below:

Formula I

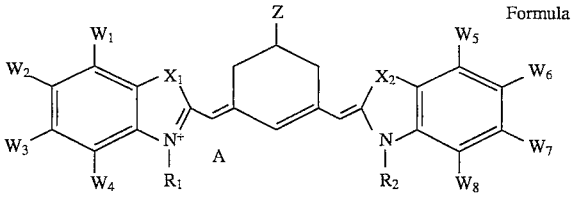

Formula II

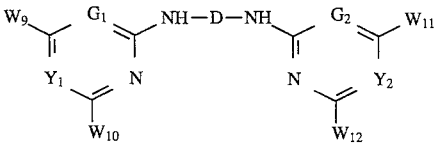

Where A, Z, X1, X2, R1, R2, W1–W12, D, G1, G2, Y1, Y2 are as defined in the specification.

11 Claims, No Drawings

RED SENSITIZERS FOR HIGH SILVER CHLORIDE EMULSIONS

This is a continuation of U.S. application Ser. No. 07/991,695, filed Dec. 16, 1992, now abandoned.

FIELD OF THE INVENTION

This invention relates to silver halide photographic elements containing red sensitizers which provide reduced density variability as a result of temperature changes.

BACKGROUND OF THE INVENTION

There is a great emphasis on high productivity in the photosensitive materials market. Photofinishers that use photosensitive paper to produce color prints desire short processing times in order to increase output. One way to obtain rapid processing is to accelerate the development time by increasing the chloride content of the emulsions; the higher the chloride content the higher the development rate. However, it is also known that the higher the chloride content is, the harder it is obtain high, invariant photosensitivity. Emulsions that are primarily silver chloride are more difficult to spectrally sensitize than emulsions used previously such as silver bromide or chlorobromide emulsions because the conduction band of silver chloride is higher than that of silver bromide (C. R. Berry, Photo. Sci. & Eng. 19, 93, (1975)).

The problem with sensitizing efficiency is especially true in the red-sensitive layer of many color print photosensitive materials and is related to the red sensitizers reduction potential. Correlations between dye reduction potentials and sensitizing efficiency on high silver chloride emulsions are discussed by W. Vanassche, J. Photo. Sci., 21, 180 (1973) and P. B. Gilman, Jr., Photo. Sci. & Eng. 18, 475 (1974). Another common problem with the red sensitive layer of color print paper which contains an emulsion that is primarily silver chloride, is an undesirable sensitivity to temperature. An increase in temperature of the paper during exposure results in an increase in red speed of the red sensitive layer making it difficult for the photofinisher to adjust his printing conditions. This results in a loss in operating efficiency.

Among the red sensitizing dye structures reported that have been used in the red sensitive layer of color print paper are dicarbocyanines having a neopentylene bridge in the pentamethine chain, such as Comparison Dye C-1 (see Table IIA below) and similar dyes (Table IIA below). U.S. Pat. No. 2,875,058 indicates that it is often advantageous to use those dyes in combination with a nitrogen heterocycle such as a triazinylstilbene. Japanese Kokai 60-220,339 teaches the use of some of those dye types on silver halide emulsions that are 25% or more silver chloride. Dicarbocyanine dyes having a gem-dimethyl substituted neopentylene bridge have been reported in EP 0 313 021 and allegedly give improved thermal sensitivity when used with high chloride emulsions. Similar dyes are described in EP 0 313 022, EP 0 317 825, U.S. Pat. No. 4,618,570, EP 0 244 184, EP 0 368 356, EP 0 367 227, and EP 0 364 990.

It is desirable to provide photographic materials with a high silver chloride red sensitive layer which has a high sensitivity and exhibits reduced thermal sensitivity.

SUMMARY OF THE INVENTION

The present invention then, provides photographic materials with a high silver chloride red sensitive layer which has a relatively high sensitivity while at the same time having relatively low thermal sensitivity. This is accomplished by a silver halide photographic material comprising a red sensitive silver halide emulsion layer the silver halide of which is at least 90 mole % silver chloride, and which emulsion has a dye of formula (I) and a compound of formula (II):

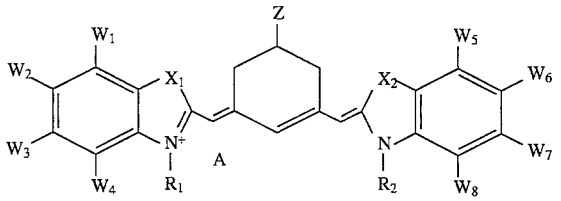

(I)

in which:

$X_1$ and $X_2$ are independently sulfur or selenium or oxygen provided that $X_1$ and $X_2$ are not both oxygen;

$R_1$ and $R_2$ each independently represent an alkyl group or a substituted alkyl group;

$W_1$–$W_8$ are independently H or substituents such that the J value of $W_{1-8}$ is 0.15 or less, where J is the sum of the Hammett $\sigma_p$ values of $W_{1-8}$;

Z represents an alkyl, acyl, acyloxy, alkoxycarbonyl, carbonyl, sulfamoyl, carboxyl, cyano, hydroxy, amino, acylamino, alkoxy, alkylthio, alkylsulfonyl, sulfonic acid, aryloxy group, or a heterocyclic ring, any of which may be substituted or unsubstituted, or a hydrogen or halogen atom;

A is a counterion if needed to balance the charge;

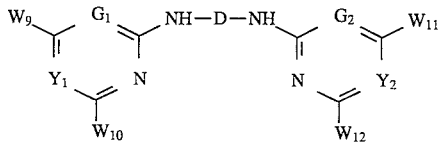

(II)

wherein:

D is a divalent aromatic moiety;

$W_9$–$W_{12}$ each independently represents a hydroxy, a halogen atom, an amino, alkylamino, arylamino, cycloalkylamino, a heterocyclic, heterocyclicamino, arylalkylamino, alkoxy, aryloxy, alkylthio, heterocyclicthio, mercapto, alkylthio, arylthio or aryl group, any of which may be substituted or unsubstituted, or a hydrogen or halogen atom;

$G_1$ and $G_2$ each represents N or CH;

$Y_1$ and $Y_2$ each represents N or CH provided at least one of $G_1$ and $Y_1$ is N and at least one of $G_2$ and $Y_2$ is N.

DETAILED DESCRIPTION OF EMBODIMENTS OF THE INVENTION

In the above formula, $W_1$–$W_8$ each independently represent an alkyl, acyl, acyloxy, alkoxycarbonyl, carbonyl, carbamoyl, sulfamoyl, carboxyl, cyano, hydroxy, amino, acylamino, alkoxy, alkylthio, alkylsulfonyl, sulfonic acid, aryl, or aryloxy group, any of which may be substituted or unsubstituted, or a hydrogen or halogen atom, and provided further that adjacent ones of W1–W8 can bonded to each other via their carbon atoms to form a condensed ring.

In particular, in formula I, Z and W1–W8 may independently be a 1 to 8 carbon alkyl (methyl, ethyl, propyl, butyl or the like), or any of W1–W8 can be a phenyl, any of which may be substituted or unsubstituted, or a hydrogen. In one type of compound of formula I each W1–W8 can independently be hydrogen or methyl. In particular W1–W8, except one of W2 or W3 and one of W6 or W7, may independently represent a hydrogen while one of W2 or W3 and one of W6 or W7 represents a hydrogen, methyl or phenyl. Z may be a methyl (which may be substituted or unsubstituted) or a hydrogen or halogen atom. Preferably Z is a relatively "flat" substituent, such as a hydrogen, halogen or a methyl (substituted or unsubstituted). More particularly Z may be a substituted or unsubstituted methyl or a hydrogen. Additionally, the J value for W1–W8 may also be less than or equal to 0.10 or 0.0, or even less than or equal to −0.10 where J is the sum of the Hammett $\sigma_p$ values of W1 through W8. Hammett $\sigma_p$ values are discussed in *Advanced Organic Chemistry* 3rd Ed., J. March, (John Wiley Sons, N.Y.; 1985). Note that the "p" subscript refers to the fact that the σ values are measured with the substituents in the para position. X1 and X2 may each particularly be sulfur. At least one of R1 or R2, or both, are alkyl of 1–8 carbon atoms, either of which alkyl may be substituted or unsubstituted. Examples of such substituents include acid or acid salt groups (for example, sulfo or carboxy groups). Thus, either or both R1 and R2 could be, for example, 2-sulfobutyl, 3-sulfopropyl and the like, or sulfoethyl.

Examples of D formula II can include

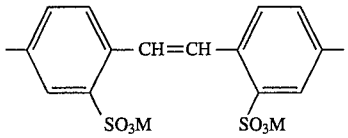

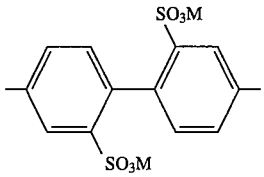

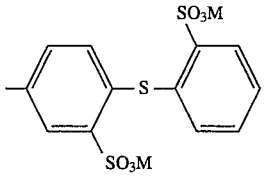

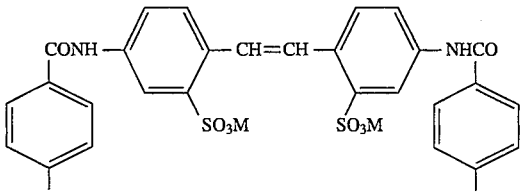

-continued

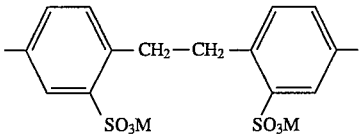

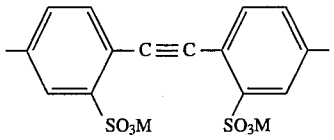

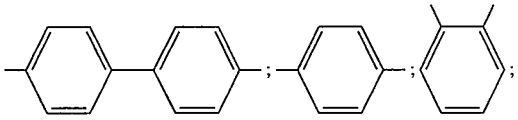

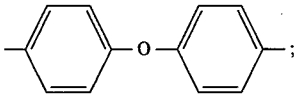

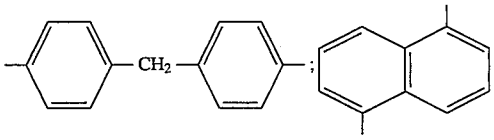

In the above, M is a hydrogen atom or a cation so as to increase water solubility, such as an alkali metal ion (Na, K, and the like) or an ammonium ion.

Examples of Formula I compounds used in materials of the present invention are listed below in Table I but the present invention is not limited to the use of those dyes

TABLE I

Invention Dyes

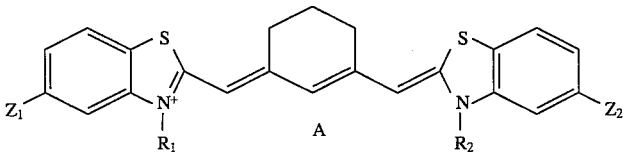

| | |
|---|---|
| I-1 | $R_1 = R_2 = Et(A = I^-$ or pts), $Z_1 = Z_2 = H$(pts = p-toluenesulfonate) |
| I-2 | $R_1 = R_2 = Me(A = I^-)$, $Z_1 = Z_2 = H$ |
| I-3 | $R_1 = Et$, $R_2 = -(CH_2)_3SO_3^-$, $Z_1 = Z_2 = H$ |
| I-4 | $R_1 = R_2 = -CH_2CH_2OH(A = Br^-)Z_1 = Z_2 = H$ |
| I-5 | $R_1 = R_2 = Et(A = I^-)$, $Z_1 = Z_2 = Ph$ |
| I-6 | $R_1 = R_2 = -(CH_2)_3SO_3^-$, $Z_1 = H$, $Z_2 = Ph$ |
| I-7 | $R_1 = R_2 = -(CH_2)_3^-$, $Z_1 = Z_2 = Ph$ |
| I-8 | $R_1 = R_2 = -(CH_2)_2CH_3$, $Z_1 = Z_2 = H$, $(A = Br^-)$ |
| I-9 | $R_1 = R_2 = -(CH_2)_3CH_3$, $Z_1 = Z_2 = H$, $(A = Br^-)$ |

TABLE I-continued

| Invention Dyes |
|---|
| 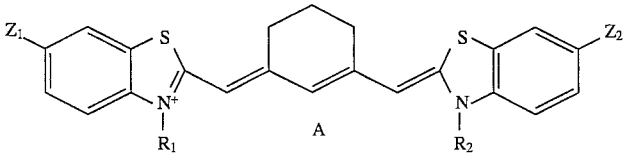 |
| I-10 $R_1 = R_2 = Et$, $Z_1 = Z_2 = Me$, ($A = pts^-$) |
| I-11 $R_1 = R_2 = -CH_2CH_2OH$, $Z_1 = Z_2 = Me$, ($A = Br^-$) |
| I-12 $R_1 = R_2 = Et$, $Z_1 = Z_2 = Et$, ($A = I^-$) |
| 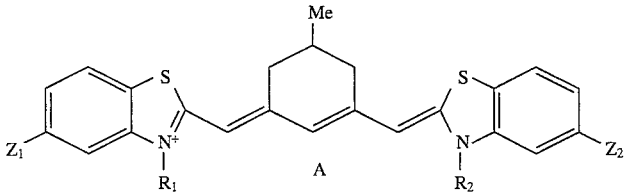 |
| I-13 $R_1 = R_2 = Et$, $Z_1 = Z_2 = H$, ($A = BF_4^-$) |
| I-14 $R_1 = Et$, $R_2 = -(CH_2)_3SO_3^-$, $Z_1 = Z_2 = H$ |
| I-15 $R_1 = R_2 = -(CH_2)_3SO_3^-$, $Z_1 = Ph$, $Z_2 = H$, $A = TEAH^+$ |
| I-16 $R_1 = -(CH_2)_3SO_3^-$, $R_2 = Et$, $Z_1 = Ph$, $Z_2 = H$ |
| 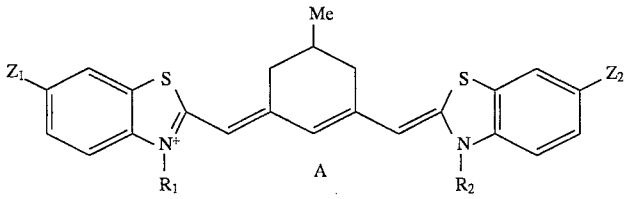 |
| I-17 $R_1 = R_2 = Et$, $Z_1 = Z_2 = Me$, ($A = I^-$) |
| I-18 $R_1 = Et$, $R_2 = -(CH_2)_4SO_3^-$, $Z_1 = Z_2 = Me$ |
| I-19 $R_1 = Et$, $R_2 = -(CH_2)_3SO_3^-$, $Z_1 = Z_2 = H$ |

Some particular examples of compounds of Formula II above are listed below. Again, the invention is not limited to the use of those specific compounds:

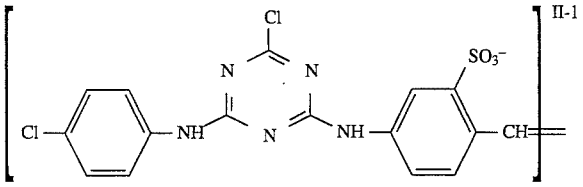

II-1

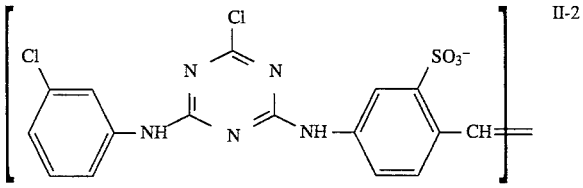

II-2

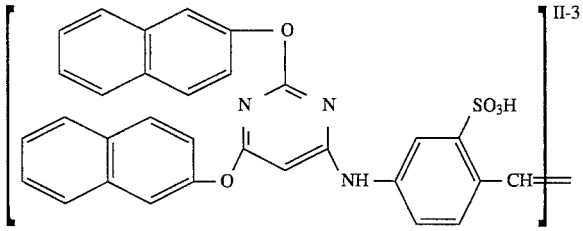

II-3

Dyes of formula I can be prepared according to techniques that are well-known in the art, such as described in Hamer, *Cyanine Dyes and Related Compounds,* 1964 (publisher John Wiley & Sons, New York, N.Y.) and James, *The Theory of the photographic Process* 4th edition, 1977 (Eastman Kodak Company, Rochester, N.Y.). The amount of sensitizing dye that is useful in the invention may be from 0.001 to 4 millimoles, but is preferably in the range of 0.01 to 4.0 millimoles per mole of silver halide and more preferably from 0.02 to 0.25 millimoles per mole of silver halide. Optimum dye concentrations can be determined by methods known in the art. Formula II compounds can be typically coated at 1/50 to 50 times the dye concentration, or more preferably 1 to 10 times.

The silver halide used in the photographic elements of the present invention preferably contains at least 90% silver chloride or more (for example, at least 95%, 98%, 99% or 100% silver chloride). Some silver bromide may be present but preferably substantially no silver iodide. Substantially no silver iodide means the iodide concentration should be no more than 1%, and preferably less than 0.5 or 0.1%. In particular, the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The photographic elements of the present invention can use the dye of formula I and the formula II compound with tabular grain emulsions such as disclosed by Wey U.S. Pat. No. 4,399,215; Kofron U.S. Pat. No. 4,434,226; Maskasky U.S. Pat. No. 4,400,463; and Maskasky U.S. Pat. No. 4,713,323; as well as disclosed in allowed U.S. applications: Ser. Nos. 819,712 (filed Jan. 13, 1992), 820,168 (filed Jan. 13, 1992), 762,971 (filed Sep. 20, 1991), 763,013 (filed Jan. 13, 1992), and pending U.S. application Ser. No. 763,030 (filed Sep. 20, 1992). The grain size of the silver halide may have any distribution known to be useful in photographic compositions, and may be ether polydipersed or monodispersed.

The silver halide grains to be used in the invention may be prepared according to methods known in the art, such as those described in *Research Disclosure,* (Kenneth Mason Publications Ltd, Emsworth, England) Item 308119, December, 1989 (hereinafter referred to as *Research Disclosure I*) and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., gold and sulfur) and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30° to 80° C., as illustrated in *Research Disclosure,* June 1975, item 13452 and U.S. Pat. No. 3,772,031.

The silver halide may be sensitized by dyes of Formula I and compounds of Formula II by methods known in the art, such as described in *Research Disclosure I.* The compounds may be added to an emulsion of the silver halide grains and a hydrophilic colloid at any time prior to (e.g., during or after chemical sensitization) or simultaneous with the coating of the emulsion on a photographic element. The resulting sensitized silver halide emulsion may be mixed with a dispersion of color image-forming coupler immediately before coating or in advance of coating (for example, 2 hours). Essentially any type of emulsion (e.g., negative-working emulsions such as surface-sensitive emulsions of unfogged internal latent image-forming emulsions, direct-positive emulsions such as surface fogged emulsions, or others described in, for example, *Research Disclosure I*) may be used. The above-described sensitizing Formula I and II compounds can be used alone, or may be used in combination with other sensitizing dyes, e.g. to also provide the silver halide with sensitivity to wavelengths of light outside the red region or to supersensitize the silver halide.

Other addenda in the emulsion may include antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein. The emulsion may also include brighteners, such as stilbene brighteners.

The emulsion layer containing silver halide sensitized with as described above, can be coated simultaneously or sequentially with other emulsion layers, subbing layers, filter dye layers, interlayers, or overcoat layers, all of which may contain various addenda known to be included in photographic elements. These include antifoggants, oxidized developer scavengers, DIR couplers, antistatic agents, optical brighteners, light-absorbing or light-scattering pigments, and the like. The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic materials of the present invention can be black and white photographic elements but are preferably color photographic elements. A color photographic element generally contains three silver emulsion layers or sets of layers (each set of layers often consisting of emulsions of the same spectral sensitivity but different speed): a blue-sensitive layer having a yellow dye-forming color coupler associated therewith; a green-sensitive layer having a magenta dye-forming color coupler associated therewith; and a red-sensitive layer having a cyan dye-forming color coupler associated therewith. Those dye forming couplers are provided in the emulsion typically by first dissolving or dispersing them in a water immiscible, high boiling point organic solvent, the resulting mixture then being dispersed in the emulsion. Suitable solvents include those in European Patent Application 87119271.2. Dye-forming couplers are well-known in the art and are disclosed, for example, in *Research Disclosure I.*

Photographic elements of the present invention may also usefully include a magnetic recording layer as described in *Research Disclosure,* Item 34390, November 1992.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977.

The invention is described further in the examples below. Comparison dyes used are listed in Table IIA below.

TABLE III

Comparison Dyes

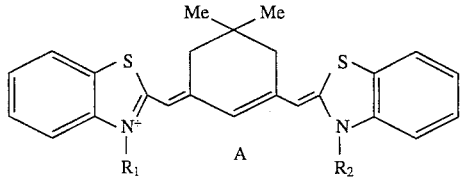

C-1 $R_1 = R_2 = Et(A = pts^-)$
C-2 $R_1 = Et, R_2 = -(CH_2)_3, SO_3^-$

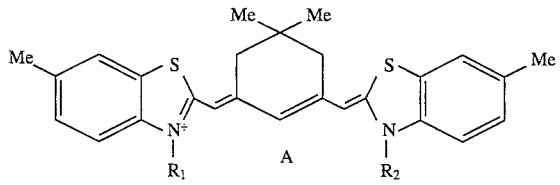

C-3 $R_1 = R_2 = Et, (A = I^-)$
C-4 $R_1 = R_2 = -(CH_2)_4CH_3, (A = I^-)$

C-5

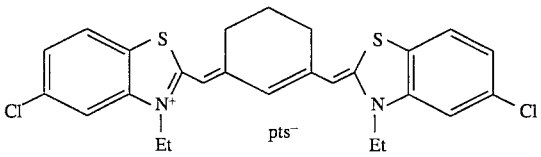

C-6

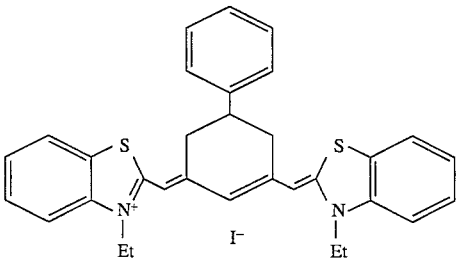

Preparation of
3,3'-Diethyl-9,11-trimethylenethiadicarbocyanine
Iodide (B-6208)

3-Ethyl-2-methylbenzothiazolium p-toluenesulfonate (7.0 g, 0.02 mol), 3-ethoxy-2-cyclohexen- 1-one (2.8 g, 0.02 mol) and pyridine (10 mL) were combined and heated at reflux for 1 hr. The mixture was cooled to 25° C. and sodium iodide (6.0 g, 0.04 mol) in 5 mL of water was added. The precipitate was collected and recrystallized twice from pyridine/water. This afforded 2.6 g (46% yield) of dye; l-max= 647 nm (MeOH), e-max=$19.78\times10^{+4}$. Anal. Calcd for $C_{26}H_{27}IN_2S_2$: C, 55.91; H, 4.87; N, 5.02. Found: C, 55.91; H, 4.84; N, 4.90.

Dye Evaluation

The dyes were coated at $3.64\times10^{-5}$ mol/mol Ag on paper support using a gold sensitized cubic silver chloride emulsion (0.39 mm (cubic edge length), 17 mg Ag/ft$^2$). Potassium bromide (0.011 mol/mol Ag), 1-(3-acetamidophenyl)-5-mercaptotetrazole (APMT; an antifoggant) and compound II-1(IX level was $18.6\times10^{-5}$ mol/mol Ag) were added in the finish.

The color coupler was 2-[2,4-bis(1,1-dimethylpropyl)phenoxy] -N-(3,5-dichloro-4-ethyl-2-hydroxyphenol)butanamide (41.6 mg/ft$^2$). A dispersion of the coupler was added to the dye/silver chloride emulsion immediately before coating. The final gel level was 154 mg/ft$^2$; the layer also had an undercoat at 300 mg/ft$^2$ of gel and an overcoat of 100 mg/ft$^2$ of gel.

The coatings were given a 0.1 second exposure, using a 0-3 step tablet (0.15 increments) with a light source designed to stimulate a color negative print exposure source. The exposure source was a 1B sensitometer, color temperature 3000° K., log lux 2.95, NP-11, 0.3 ND (Neutral Density), and HA50 (Hoya 50) filters. The elements were then processed with RA-4 chemistry through a Colenta processor. This consists of a color development (45 sec, 35° C.), bleach-fix (45 sec, 35° C.) and stabilization or water wash (90 sec, 35° C.) followed by drying (60 sec, 60° C.). The speed at 1.0 density units above Dmin is listed in Tables III–VI.

| Color Developer | |
|---|---|
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonylaminoethyl)-2-methyl-phenylenediaminesesquisulfatemonohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2 | |

Heat sensitivity data was obtained on a sensitometer which was modified so that one half of the platten was heated to 100° F. and the other half was kept at 60° F. A 0.3 second exposure was made with a 3000° K. light source with a filter pack that included a heat absorber filter (Hoya 50), and 0.65 magenta, 0.95 yellow, 1.225 neutral density filters. The coatings were processed with RA-4 chemistry. The change in speed due to temperature variation (D speed) is calculated at the 0.8 density point of the D log E curve.

TABLE III

| Dye | APMT (mg/mol) | Speed | Heat Sensitivity Δ speed |
|---|---|---|---|
| I-18 (I) | 131 | 174 | 0.019 |
| I-18 (I) | 96 | 197 | 0.002 |
| I-19 (I) | 131 | 158 | 0.022 |

TABLE III-continued

| Dye | APMT (mg/mol) | Speed | Heat Sensitivity Δ speed |
|---|---|---|---|
| I-19 (I) | 96 | 185 | 0.016 |
| C-3 (C) | 131 | 153 | 0.032 |
| C-1 (C) | 131 | 172 | 0.038 |
| C-2 (C) | 131 | 153 | 0.024 |

*Compound II-1 at 1X level
(I) in all tables indicates the particular combination is one of the present invention
(C) in all tables indicates the particular combination is not one of the present invention

TABLE IV

| Dye | Compound II-1 level | APMT | Speed | Heat Sensitivity D speed |
|---|---|---|---|---|
| I-2 (I) | 1X | 131 | 199 | 0.046 |
| I-2 (I) | 1X | 96 | 206 | 0.044 |
| I-3 (I) | 1X | 131 | 192 | 0.032 |
| I-3 (I) | 1X | 96 | 202 | 0.036 |
| I-2 (C) | 0 | 131 | 131 | 0.040 |
| I-3 (C) | 0 | 131 | 118 | 0.135 |
| C-3 (C) | 1X | 131 | 188 | 0.023 |
| C-3 (C) | 0 | 131 | 194 | 0.058 |
| C-1 (C) | 1X | 131 | 183 | 0.046 |
| C-1 (C) | 0 | 131 | 179 | 0.079 |
| C-2 (C) | 1X | 131 | 167 | 0.037 |
| C-2 (C) | 0 | 131 | 177 | 0.076 |

TABLE V

| Dye | Compound II-1 level | APMT (mg/Mol) | Speed | Heat Sensitivity D speed |
|---|---|---|---|---|
| I-1 (I) | 1X | 131 | 196 | 0.024 |
| I-1 (I) | 1X | 96 | 206 | 0.025 |
| I-10 (I) | 1X | 131 | 198 | 0.013 |
| I-10 (I) | 1X | 96 | 205 | 0.008 |
| I-1 (C) | 0 | 131 | 164 | 0.036 |
| I-10 (C) | 0 | 131 | 121 | 0.059 |
| C-2 (C) | 1X | 131 | 166 | 0.030 |
| C-2 (C) | 0 | 131 | 176 | 0.060 |

TABLE VI

| Dye | Speed | Heat Sensitivity D speed |
|---|---|---|
| I-1 (I) | 210 | 0.031 |
| I-2 (I) | 209 | 0.022 |
| I-4 (I) | 205 | 0.001 |
| I-5 (I) | 204 | 0.040 |
| I-13 (I) | 206 | 0.021 |
| C-1 (C) | 194 | 0.043 |
| C-6 (C) | 189 | 0.060 |
| C-5 (C) | 190 | 0.065 |
| I-3 (I) | 205 | −0.010 |
| I-14 (I) | 202 | 0.029 |
| C-2 (C) | 177 | 0.053 |
| I-10 (I) | 205 | 0.010 |
| I-12 (I) | 202 | 0.020 |
| I-17 (I) | 202 | 0.007 |
| I-11 (I) | 199 | −0.022 |
| I-18 (I) | 196 | −0.023 |
| C-4 (C) | 195 | 0.064 |

*APMT 114 mg/mol; Compound II-1 at 1X

The results in Table III–VI indicate that the dyes of the invention, in combination with formula II compounds, are excellent sensitizers and offer significantly reduced thermal sensitivity versus the comparison dyes in combination with formula II compounds.

What is claim is:

1. A silver halide photographic material comprising a red sensitive silver halide emulsion layer the silver halide of which is at least 90 mole % silver chloride, and which emulsion has a dye of formula (I) and a compound of formula (II):

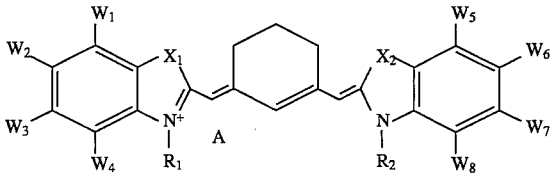

(I)

in which:

$X_1$ and $X_2$ are independently sulfur or selenium or oxygen provided that $X_1$ and $X_2$ are not both oxygen;

$R_1$ and $R_2$ each independently represent an alkyl group or a substituted alkyl group;

$W_1$–$W_8$ are independently H or substituents such that the J value of $W_1$–$W_8$ is 0.15 or less, where J is the sum of the Hammett $\sigma_p$ values of $W_1$–$W_8$, and $W_2$, $W_3$, $W_6$ and $W_7$ independently represent: an ethyl, propyl, butyl, acyl, acyloxy, alkoxycarbonyl, carbonyl, carbamoyl, sulfamoyl, carboxyl, cyano, hydroxy, amino, acylamino, alkylthio, alkylsulfonyl, sulfonic acid, aryl, or aryloxy group or a hydrogen or halogen atom;

A is a counterion if needed to balance the charge;

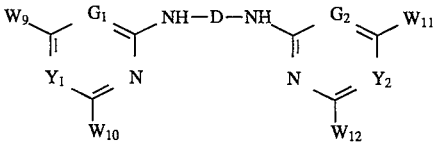

(II)

wherein:

D is a divalent aromatic moiety;

$W_9$–$W_{12}$ each independently represents a hydroxy, an amino, alkylamino, arylamino, cycloalkylamino, a heterocyclic, heterocyclicamino, arylalkylamino, alkoxy, aryloxy, heterocyclicthio, mercapto, alkylthio, arylthio or aryl group, or a hydrogen or halogen atom;

$G_1$ and $G_2$ each represents N or CH;

$Y_1$ and $Y_2$ each represents N or CH provided at least one of $G_1$ and $Y_1$ is N and at least one of $G_2$ and $Y_2$ is N.

2. A silver halide photographic material according to claim 1 wherein $W_1$, $W_4$, $W_5$, and $W_8$ each independently represent an alkyl, acyl, acyloxy, alkoxycarbonyl, carbonyl, carbamoyl, sulfamoyl, carboxyl, cyano, hydroxy, amino, acylamino, alkoxy, alkylthio, alkylsulfonyl, sulfonic acid, aryl, or aryloxy group.

3. A silver halide photographic material according to claim 2 wherein $W_1$, $W_4$, $W_5$, and $W_8$ each independently represent an alkyl or aryl group, and $W_2$, $W_3$, $W_6$ and $W_7$ each independently represent an ethyl, propyl, butyl or aryl group and provided further that $W_1$ and $W_2$, or $W_2$ and $W_3$, or $W_3$ and $W_4$, or $W_5$ and $W_6$, or $W_6$ and $W_7$, or $W_7$ and $W_8$, can be bonded to each other to form a condensed ring.

4. A silver halide photographic material according to claim 1 wherein $W_9$–$W_{12}$ each independently represent an aryloxy or arylamino group.

5. A silver halide photographic material according to claim 1, wherein J is defined as the sum of the Hammett $\sigma_p$ values of $W_{1-8}$, and J is 0.0 or less.

6. A silver halide photographic material according to claim 1, wherein $W_1$–$W_8$ independently represents hydrogen or aryl.

7. A silver halide photographic material according to claim 1, wherein $X_1$ and $X_2$ are sulfur.

8. A silver halide photographic material according to claim 1, wherein at least one of $R_1$ and $R_2$ is an alkyl groups of 1–8 carbon atoms.

9. A silver halide photographic material according to claim 1, wherein both of $R_1$ and $R_2$ are alkyl groups of 1–8 carbon atoms.

10. A silver halide photographic material according to claim 1 wherein the silver halide is at least 95% silver chloride.

11. A silver halide photographic material according to claim 1 additionally comprising a heterocyclic mercapto antifoggant compound.

* * * * *